US011572524B1

(12) United States Patent
Lehner

(10) Patent No.: US 11,572,524 B1
(45) Date of Patent: Feb. 7, 2023

(54) LUBRICATING COMPOSITION FOR DIFFERENTIAL AND GEAR FLUIDS

(71) Applicant: AFTON CHEMICAL CORPORATION, Richmond, VA (US)

(72) Inventor: Carey Lehner, Midlothian, VA (US)

(73) Assignee: Afton Chemical Corporation, Richmond, VA (US)

( * ) Notice: Subject to any disclaimer, the term of this patent is extended or adjusted under 35 U.S.C. 154(b) by 0 days.

(21) Appl. No.: 17/824,732

(22) Filed: May 25, 2022

(51) Int. Cl.

| | |
|---|---|
| ***C10M 135/00*** | (2006.01) |
| ***C10M 135/20*** | (2006.01) |
| ***C10M 135/36*** | (2006.01) |
| ***C10M 137/12*** | (2006.01) |
| *C10N 10/16* | (2006.01) |

(52) U.S. Cl.
CPC ..... *C10M 135/20* (2013.01); *C10M 135/36* (2013.01); *C10M 137/12* (2013.01); *C10N 2010/16* (2013.01)

(58) Field of Classification Search
CPC ..... C10M 135/20; C10M 135/36; C10M 137/12; C10N 2010/16
See application file for complete search history.

(56) References Cited

U.S. PATENT DOCUMENTS

| | | | |
|---|---|---|---|
| 2,237,625 | A | 4/1941 | Olin |
| 2,237,627 | A | 4/1941 | Olin |
| 2,527,948 | A | 10/1950 | Lyon, Jr. et al. |
| 2,695,316 | A | 11/1954 | McBride |
| 2,749,311 | A | 6/1956 | Sabol et al. |
| 2,760,933 | A | 8/1956 | Fields et al. |
| 2,765,289 | A | 10/1956 | Fields et al. |
| 2,850,453 | A | 9/1958 | Fields |
| 2,910,439 | A | 10/1959 | Fields |
| 2,995,569 | A | 8/1961 | Hamilton et al. |
| 3,022,351 | A | 2/1962 | Mihm et al. |
| 3,308,166 | A | 3/1967 | Biensan et al. |
| 3,392,201 | A | 7/1968 | Warner |
| 3,471,404 | A | 10/1969 | Myers |
| 3,663,561 | A | 5/1972 | Blaha |
| 3,673,090 | A | 6/1972 | Waldbillig et al. |
| 3,703,504 | A | 11/1972 | Horodysky |
| 3,703,505 | A | 11/1972 | Horodysky et al. |
| 3,796,661 | A | 3/1974 | Suratwala et al. |
| 3,840,549 | A | 10/1974 | Blaha et al. |
| 3,862,798 | A | 1/1975 | Hopkins |
| 3,873,454 | A | 3/1975 | Horodysky et al. |
| 4,119,549 | A | 10/1978 | Davis |
| 4,119,550 | A | 10/1978 | Davis et al. |
| 4,147,640 | A | 4/1979 | Jayne et al. |
| 4,191,659 | A | 3/1980 | Davis |
| 4,204,969 | A | 5/1980 | Papay |
| 4,218,332 | A | 8/1980 | Schwab et al. |
| 4,240,958 | A | 12/1980 | Braid |
| 4,344,854 | A | 8/1982 | Davis et al. |
| 4,472,306 | A | 9/1984 | Powers, III et al. |
| 4,564,709 | A | 1/1986 | Koyama et al. |
| 4,711,736 | A | 12/1987 | Horodysky et al. |
| 4,795,576 | A | 1/1989 | Born et al. |
| 4,954,274 | A | 9/1990 | Zaweski |
| 4,966,720 | A | 10/1990 | DeGonia et al. |
| 5,091,112 | A | 2/1992 | Perozzi et al. |
| 5,174,922 | A | 12/1992 | Perozzi et al. |
| 5,266,223 | A | 11/1993 | Song et al. |
| 6,689,723 | B2 * | 2/2004 | Sullivan ..... C10M 163/00 508/192 |
| 6,884,855 | B2 | 4/2005 | Nelson |
| 7,414,013 | B2 | 8/2008 | Nelson et al. |
| 9,090,850 | B1 | 7/2015 | Edwards et al. |
| 9,469,825 | B2 | 10/2016 | Tang |
| 2012/0101017 | A1 | 4/2012 | Duggal |

FOREIGN PATENT DOCUMENTS

| | | | |
|---|---|---|---|
| EP | 0411861 | B1 | 3/1993 |
| EP | 1471133 | B1 | 7/2011 |
| GB | 1162334 | A | 8/1969 |
| GB | 1308894 | A | 3/1973 |

* cited by examiner

*Primary Examiner* — Taiwo Oladapo
(74) *Attorney, Agent, or Firm* — Honigman LLP

(57) ABSTRACT

A gear fluid composition for lubricating a driveline including organic sulfide compounds effective to achieve passing friction, extreme pressure, and copper corrosion.

23 Claims, No Drawings

LUBRICATING COMPOSITION FOR DIFFERENTIAL AND GEAR FLUIDS

TECHNICAL FIELD

The present disclosure relates to lubricating composition for gear oils, limited-slip applications, and/or power transmission fluids having improved characteristics for extreme pressure, friction, and/or copper corrosion.

BACKGROUND

Gears, transmissions, and/or axles commonly require lubricants that provide specific friction characteristics suitable for the desired application. For instance, axles, transfer cases, differentials, including straight differentials, turning differentials, limited-slip differentials, clutch-type differentials, and locking differentials to suggest but a few types, are often provided in many vehicles and each requires unique lubricating compositions. The limited-slip differential, for instance, is a driveline component to counteract a situation where one of two driving wheels has less traction than the other wheel. This situation may be due to, for example, loose soil, sand, mud, or ice under one wheel. In a standard open or non-limited-slip differential, the driving wheel with lower traction receives all of the powertrain torque, but then may spin without moving the vehicle in the desired direction due to the lower traction. In a limited-slip differential, a mechanism divides, or shares, a portion of the torque delivered by the powertrain with both driving wheels. By sharing the available torque, a wheel with some traction receives enough torque to move the vehicle in the desired direction. In addition, high performance vehicles often have so much torque that in certain turning situations the torque on one wheel exceeds the available traction and, thus, performance suffers. The limited-slip differential shares the torque between both wheels, enhancing the performance of the vehicle.

Axles, transfer cases, and differential driveline components often have a variety of mechanisms to provide power and/or torque transfer from, for instance, an input pinion gear to opposing wheels of an axle shaft. One common mechanism for a limited-slip differential is a multi-plate wet clutch that transfers torque from the differential carrier to the side gear. These multi-plate clutches typically have a set of friction plates of one material (that is, a facing material) and a set of steel plates. One set of plates is linked to the differential carrier, while the other set of plates is linked to the side gear. As the side gear drives the axle shaft, torque is therefore transferred to the axle shaft and to the wheel of the vehicle, which then provides a motive force to the vehicle.

The driveline components including axles, transfer cases, limited-slip differentials, and the like all include a lubricant configured for such unique applications. Typically, such lubricants require that the fluid have proper extreme pressure performance, proper friction characteristics, and suitable copper corrosion performance among other performance requirements. A number of additives may be included in the lubricant to achieve desired performance. For instance, such lubricants may often include a sulfurized additive to protect gears and other components from wear and scoring. However, while a sulfurized additive may provide good extreme pressure and wear-scar performance for the desired application, prior sulfurized additives tend to be detrimental to copper and copper alloys leading to unacceptable copper corrosion and friction.

SUMMARY

In one approach or embodiment, a lubricating composition including one or more base oil of lubricating viscosity and at least about 1 weight percent of total sulfur provided by one or more additives and wherein a majority of the total sulfur is provided by organic sulfide compounds is described herein. In aspects, each organic sulfide compound, independently, has a structure of the formula $R_1-S_x-R_2$ wherein $R_1$ and $R_2$, independently, are a C2 to C20 hydrocarbyl group and x is an integer of at least 2; wherein the organic sulfide compounds have a weight ratio of organic sulfide compounds with $S_3$ moieties to $S_4$ moieties of 3:1 to 6:1, about 1 to about 5 weight percent of compounds with a $S_5$ moiety and no more than about 1 weight percent of compounds with a $S_6$ moiety; a thiadiazole or a derivative thereof; and a phosphorous containing friction modifier providing a hydrocarbyl phosphonate monoester.

In other embodiments or approaches, the lubricating compositions of the previous paragraph may be combined with optional additives and/or features in any combination. These optional features or embodiments may include one or more the following: wherein the lubricating composition includes about 1.3 to about 3 weight percent of total sulfur, at least about 90 weight percent of the total sulfur is provided by the organic sulfide compounds having about 10 to about 15 weight percent of organic sulfide compounds with a $S_2$ moiety, about 60 to about 70 weight percent of compounds with a $S_3$ moiety, and about 12 to about 20 weight percent of compounds with a $S_4$ moiety; and/or wherein the organic sulfide compounds are provided by a first organic sulfide reaction product and a second organic sulfide reaction product; and/or wherein the first organic sulfide reaction product includes a combination of organic sulfide compounds with a weight ratio of organic sulfide compounds with $S_3$ moieties to $S_4$ moieties of 20:1 to 30:1, no more than about 1 weight percent of compounds with a $S_5$ moiety, and no more than about 1 weight percent of compounds with a $S_6$ moiety; and/or wherein the first organic sulfide reaction product has about 10 to about 14 percent organic sulfide compounds with an $S_2$ moiety, about 70 to about 90 weight percent of organic sulfide compounds with a $S_3$ moiety, and about 1 to about 6 weight percent of organic sulfide compounds with an $S_4$ moiety; and/or wherein the second organic sulfide reaction product includes a combination of organic sulfide compounds with a weight ratio of organic sulfide compounds with $S_3$ moieties to $S_4$ moieties of 1.5:1 to 5:1, about 1 to about 5 weight percent of compounds with a $S_5$ moiety, and no more than about 1 weight percent of compounds with a $S_6$ moiety; and/or wherein the second organic sulfide reaction product includes about 10 to about 14 percent organic sulfide compounds with an $S_2$ moiety, about 50 to about 60 weight percent of organic sulfide compounds with a $S_3$ moiety, and about 25 to about 30 weight percent of organic sulfide compounds with an $S_4$ moiety; and/or wherein the lubricating composition includes about 1.5 to about 2.8 weight percent of the first organic sulfide reaction product and about 1.5 to about 2.8 weight percent of the second organic sulfide reaction product; and/or wherein the lubricating composition includes a weight ratio of the first organic sulfide reaction product to the second organic sulfide reaction product of about 0.8:1 to about 1:0.8; and/or wherein $R_1$ and $R_2$, independently, are selected from propyl, isopropyl, butyl, isobutyl, tert-butyl, or combinations thereof; and/or wherein the hydrocarbyl phosphonate monoester has a structure of Formula II

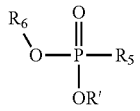

(Formula II) wherein $R_5$ is a $C_{12}$ to $C_{30}$ hydrocarbyl group, $R_6$ is a C1 to C4 alkyl group, and R' is hydrogen or an alkyl group; and/or wherein the lubricating composition includes about 0.1 weight percent to about 0.8 weight percent of the hydrocarbyl phosphonate monoester; and/or wherein the thiadiazole or derivative thereof is selected from a mono hydrocarbyl thiol-substituted thiadiazole, a bishydrocarbyl thiol-substituted thiadiazole, or combinations thereof; and/or wherein the thiadiazole is 1,3,4-thiadiazole or derivative thereof; and/or wherein the lubricating composition includes about 1 weight percent or less of the thiadiazole or derivative thereof; and/or wherein the thiadiazole or derivative thereof includes one or more compounds having a structure of Formula I:

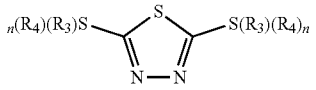

(Formula I) wherein each $R_3$ is independently hydrogen or sulfur; each $R_4$ is independently an alkyl group; n is an integer of 0 or 1 and if $R_3$ is hydrogen then the integer n of the adjacent $R_4$ moiety is 0 and if $R_3$ is sulfur then the n of the adjacent $R_4$ moiety is 1; and wherein at least one $R_3$ is sulfur; and/or wherein the lubricating composition exhibits about 100mm$^2$ or less damage in a FZG sprung test at 90° C. at load stage 9 or above when compared to a reference fluid and about 200mg or less copper corrosion pursuant to ASTM D130.

In other approaches or embodiments, a driveline lubricating composition is described herein including at least about 1 weight percent of total sulfur provided by a mixture of at least two dihydrocarbyl sulfide reaction products, each dihydrocarbyl sulfide reaction product is obtained from a source of sulfur reacted with one or more C2 to C20 hydrocarbyl or olefin compounds, and wherein the source of sulfur is substantially devoid of sulfur chlorides, hydrogen sulfides, and combinations thereof; the first dihydrocarbyl sulfide reaction product includes a combination of organic sulfide compounds with a weight ratio of organic sulfide compounds with $S_3$ moieties to $S_4$ moieties of 20:1 to 30:1, no more than about 1 weight percent of compounds with a $S_5$ moiety, and no more than about 1 weight percent of compounds with a $S_6$ moiety; the second dihydrocarbyl sulfide reaction product includes a combination of organic sulfide compounds with a weight ratio of organic sulfide compounds with $S_3$ moieties to $S_4$ moieties of 1.5:1 to 5:1, about 1 to about 5 weight percent of compounds with a $S_5$ moiety, and no more than about 1 weight percent of compounds with a $S_6$ moiety; a thiadiazole or a derivative thereof; and a phosphorous containing friction modifier providing a hydrocarbyl phosphonate monoester.

In other embodiments or approaches, the lubricating compositions of the previous paragraph may be combined with optional additives and/or features in any combination. These optional features or embodiments may include one or more the following: wherein the source of sulfur is elemental sulfur; and/or wherein the lubricating composition includes a weight ratio of the first dihydrocarbyl sulfide reaction product to the second dihydrocarbyl sulfide reaction product of about 0.8:1 to about 1:0.8; ; and/or wherein the hydrocarbyl phosphonate monoester has a structure of Formula II

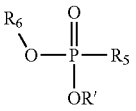

(Formula II) wherein $R_5$ is a $C_{12}$ to $C_{30}$ hydrocarbyl group and $R_6$ is a C1 to C4 alkyl group, and R' is hydrogen or an alkyl group; ; and/or wherein the lubricating composition includes about 0.1 weight percent to about 0.8 weight percent of the hydrocarbyl phosphonate monoester; and/or wherein the thiadiazole or derivative thereof is selected from a mono hydrocarbyl thiol-substituted thiadiazole, a bishydrocarbyl thiol-substituted thiadiazole, or combinations thereof; and/or wherein the lubricating composition includes about 1 weight percent or less of the thiadiazole or derivative thereof; and/or wherein the thiadiazole or derivative thereof includes one or more compounds having a structure of Formula I:

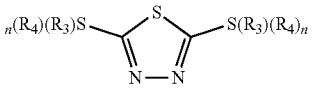

(Formula I) wherein each $R_3$ is independently hydrogen or sulfur; each $R_4$ is independently an alkyl group; n is an integer of 0 or 1 and if $R_3$ is hydrogen then the integer n of the adjacent $R_4$ moiety is 0 and if $R_3$ is sulfur then the n of the adjacent $R_4$ moiety is 1; and wherein at least one $R_3$ is sulfur; and/or wherein the lubricating composition exhibits about 100mm$^2$ or less damage in a FZG sprung test at 90° C. at load stage 9 or above and about 200mg or less copper corrosion pursuant to ASTM D130.

In yet other embodiments or approaches, the use of any embodiment of lubricating compositions herein is provided for achieving about 100mm$^2$ or less damage in a FZG sprung test at 90° C. at load stage 9 or above and about 200mg or less copper corrosion pursuant to ASTM D130.

In further embodiments or approaches, the method is provided for lubricating a driveline component with a lubricating composition of any embodiment herein.

Other embodiments of the present disclosure will be apparent to those skilled in the art from consideration of the specification and practice of the invention disclosed herein. The following definitions of terms are provided in order to clarify the meanings of certain terms as used herein.

The terms "gear oil," "gear fluid," "gear lubricant," "base gear lubricant," "lubricating oil," "lubricant composition," "lubricating composition," "lubricant" and "lubricating fluid" refer to a finished lubrication product comprising a major amount of a base oil plus a minor amount of an additive composition as discussed herein. Such gear fluids are for use in extreme pressure situations such as for transmissions and gear drive components having metal-on-metal contact situations, for instance, in a transmission and/or a limited-slip differential.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having a predominantly hydrocarbon character. Each hydrocarbyl group is independently selected from hydrocarbon substituents, and substituted hydrocarbon substituents containing one or more of halo groups, hydroxyl groups, alkoxy groups, mercapto groups, nitro groups, nitroso groups, amino groups, pyridyl groups, furyl groups, imidazolyl groups, oxygen and nitrogen, and wherein no more than two non-hydrocarbon substituents are present for every ten carbon atoms in the hydrocarbyl group.

As used herein, the term "percent by weight" or "wt%", unless expressly stated otherwise, means the percentage the recited component represents to the weight of the entire composition. All percent numbers herein, unless specified otherwise, is weight percent.

The terms "soluble," "oil-soluble," or "dispersible" used herein may, but does not necessarily, indicate that the compounds or additives are soluble, dissolvable, miscible, or capable of being suspended in the oil in all proportions. The foregoing terms do mean, however, that they are, for instance, soluble, suspendable, dissolvable, or stably dispersible in oil to an extent sufficient to exert their intended effect in the environment in which the oil is employed. Moreover, the additional incorporation of other additives may also permit incorporation of higher levels of a particular additive, if desired.

The term "alkyl" as employed herein refers to straight, branched, cyclic, and/or substituted saturated chain moieties from about 1 to about 200 carbon atoms. The term "alkenyl" as employed herein refers to straight, branched, cyclic, and/or substituted unsaturated chain moieties from about 3 to about 30 carbon atoms. The term "aryl" as employed herein refers to single and multi-ring aromatic compounds that may include alkyl, alkenyl, alkylaryl, amino, hydroxyl, alkoxy, halo substituents, and/or heteroatoms including, but not limited to, nitrogen, and oxygen.

As used herein, the molecular weight is determined by gel permeation chromatography (GPC) using commercially available polystyrene standards (with a Mn of about 180 to about 18,000 as the calibration reference). The molecular weight (Mn) for any embodiment herein may be determined with a gel permeation chromatography (GPC) instrument obtained from Waters or the like instrument and the data processed with Waters Empower Software or the like software. The GPC instrument may be equipped with a Waters Separations Module and Waters Refractive Index detector (or the like optional equipment). The GPC operating conditions may include a guard column, 4 Agilent PLgel columns (length of 300×7.5 mm; particle size of 5μ, and pore size ranging from 100-10000 Å) with the column temperature at about 40 ° C. Un-stabilized HPLC grade tetrahydrofuran (THF) may be used as solvent, at a flow rate of 1.0 mL/min. The GPC instrument may be calibrated with commercially available polystyrene (PS) standards having a narrow molecular weight distribution ranging from 500-380,000 g/mol. The calibration curve can be extrapolated for samples having a mass less than 500 g/mol. Samples and PS standards can be in dissolved in THF and prepared at concentration of 0.1-0.5 weight percent and used without filtration. GPC measurements are also described in US 5,266,223, which is incorporated herein by reference. The GPC method additionally provides molecular weight distribution information; see, for example, W . W. Yau, J. J. Kirkland and D. D. Bly, "Modern Size Exclusion Liquid Chromatography", John Wiley and Sons, New York, 1979, also incorporated herein by reference.

As used herein, any sulfur moiety distributions or ratios were determined using CNMR via a Bruker Avance-3 HD 500MHz instrument equipped with a 5mm BBO Prodigy probe (or equivalent). Samples were dissolved in chloroform-d, about 3% wt/wt for the $^{1}H$ NMR one-dimensional (1D) and two-dimensional (2D) homonuclear experiments and about 30% wt/wt for the $^{13}C$ 1D and 2D heteronuclear experiments. The chloroform-d was used as the chemical shift reference, $d_H$=7.27 and $d_C$=77.0ppm, respectively. The experiments were conducted at ambient temperature. The direct observe 1D $^{1}H$ and $^{13}C$-$^{1}H$ decoupled experiments were performed under quantitative conditions using ninety-degree pulse widths, 5×T1 delays and gated $^{1}H$ decoupling for the $^{13}C$ NMR experiments. In addition, a Distortionless Enhancement by Polarization Transfer (DEPT) experiment, using the 135-degree pulse option was also acquired. The 2D experiments used to assist in structural assignments were Homonuclear Correlated Spectroscopy (COSY), Heteronuclear Single Quantum Coherence (HSQC) and Heteronuclear Multiple Bond Correlation (HMBC). All NMR data was acquired using the Bruker Topspin 3.62 software from Bruker Inc of Billerica MA and processed using ACD/Spectrus Processor 2021.1.3 software from Advanced Chemistry Development, Inc. using standard parameters (or equivalent equipment/software).

It is to be understood that throughout the present disclosure, the terms "comprises," "includes," "contains," etc. are considered open-ended and include any element, step, or ingredient not explicitly listed. The phrase "consists essentially of" is meant to include any expressly listed element, step, or ingredient and any additional elements, steps, or ingredients that do not materially affect the basic and novel aspects of the invention. The present disclosure also contemplates that any composition described using the terms, "comprises," "includes," "contains," is also to be interpreted as including a disclosure of the same composition "consisting essentially of" or "consisting of" the specifically listed components thereof.

DETAILED DESCRIPTION

In one approach or embodiment, disclosed herein are lubricating compositions suitable for gear fluids, power transmission fluids, and/or axle or limited-slip applications having at least about 1.0 weight percent of total sulfur (in some approaches, about 1 weight percent to about 4 weight percent, about 1.3 to about 3 weight percent, or about 1.3 weight percent to about 2.5 weight percent total sulfur) with a majority of the total sulfur provided, in some instances, by organic sulfide compounds having a certain profile of sulfur moieties. In one aspect, each organic sulfide compound, independently, has a structure of the formula $R_1$–$S_x$–$R_2$ wherein $R_1$ and $R_2$, independently, are a C2 to C20 hydrocarbyl group and x is an integer of at least 2 and, preferably 2 to 6. In one approach, the organic sulfide compounds is provided by two separate reaction products wherein each reaction product includes a specific combination of organic sulfide compounds having a certain profile of $-S_2-$, $-S_3-$, $-S_4-$, $-S_5-$, and/or $-S_6-$ sulfur moieties or groups, and, in some approaches, the compositions and/or each reaction product has a certain weight ratio of $S_3$ to $S_4$ sulfur moieties.

For instance, the organic sulfide compounds in the lubricating composition preferably are provided by (1) a first organic sulfide reaction product having a mix of compounds with a high level of $-S_3-$ sulfur groups and (2) a second organic sulfide reaction product having a mix of compounds with balanced amounts of $-S_3-$ and $-S_4-$ sulfur groups. In other embodiments, the lubricating compositions herein also include, in addition to the organic sulfide compounds, a thiadiazole or a derivative thereof, and a phosphorous containing friction modifier providing a hydrocarbyl phosphonate monoester. In some approaches, when the lubricating composition includes the organic sulfide compounds with the defined profiles/ratios of sulfur groups together with the optional thiadiazole and optional phosphorous containing friction modifier, the lubricant exhibits good friction performance, good wear scar performance, and good copper corrosion performance.

Organic Sulfide Compounds

The lubricating composition herein include organic sulfide compounds that, in one embodiment or approach, are provided by a combination of two or more different organic sulfide reaction products. In approaches, the combined first and second reaction products provides at least about 90 weight percent or more of the total sulfur in the lubricating composition and, in other approaches, the combined reaction products provides about 92 to about 99 weight percent of the total sulfur in the lubricating composition, or about 95 to about 98 weight percent of the total sulfur in the lubricating composition. Each reaction product includes a certain combination/ratio of different organic sulfide compounds with a specific profile of $S_2$-$S_6$ compounds.

More specifically, each reaction product herein is a dihydrocarbyl sulfide compound having a structure of the formula $R_1$-$S_x$-$R_2$ wherein $R_1$ and $R_2$, independently, are a C2 to C20 hydrocarbyl group and x is an integer of at least 2 (and preferably, 2 to 6, 2 to 5, or 2 to 4) suitable to achieve the sulfur ratios and profiles of each reaction product and overall fluids herein. That is, each hydrocarbyl group of the organic sulfide in the reaction product has 2 to 20 carbon atoms, preferably from 3 to 10 carbon atoms, or more preferably, 3 to 4 carbon atoms. In approaches, each hydrocarbyl group of the organic sulfide compound may be aromatic or aliphatic, preferably, the hydrocarbyl groups may be aliphatic groups such as alkyl, alkenyl, cycloalkyl, cycloalkylalkyl, aryl, aralkyl, cycloalkenyl, or the like, and most preferably, the hydrocarbyl groups are alkyl groups. Suitable alkyl groups may be propyl, iso-propyl, butyl, iso-butyl, and/or tert-butyl groups. In approaches, each hydrocarbyl group may be derived from olefins. In such approaches, the olefin may have from 2 to 20 carbon atoms or other ranges are set forth above.

Suitable olefins for preparing each of organic sulfide compounds herein may be mono or disubstituted monoolefins that include 2 to 12 carbon atoms. A disubstituted monoolefins is an olefin having at least one double bonded carbon atom having two alkyl substituents. Examples of suitable olefins for deriving the organic sulfides include ethylene, propylene, butylene, isobutylene, 2-methyl-2-pentene, 2-methyl2-butene, 2- methyl-1-butene, diisobutylene, triisobutylene, and mixtures thereof as well as dimers, trimers, tetramers, and mixtures thereof may be suitable hydrocarbyl groups for each of the organic sulfides herein.

Each of the organic sulfide compounds herein may be prepared by reacting, optionally under super-atmospheric pressure, one or more of the above hydrocarbyl or olefin compounds with a source of sulfur (preferably, elemental sulfur or molten sulfur) in the presence, or absence, of a catalyst, such as an optional alkyl amine catalyst, followed by removal of low boiling materials. Preferably, the source of sulfur is substantially devoid of sulfur chlorides, hydrogen sulfides, and combinations thereof and, in this context, reactions herein have about 0.1 weight percent or less, about 0.05 weight percent or less, about 0.01 weight percent or less, or no sulfur chlorides, hydrogen sulfides, or the like.

In embodiments, suitable organic sulfides herein may be obtained, for example, with an olefin or hydrocarbyl compound combined or reacted with elemental sulfur in ratios of about 2:1 to about 1:2 moles of olefin/hydrocarbyl to grams of sulfur in an autoclave or other reaction vessel that is suitable for conducting super-atmospheric pressure and elevated temperature reactions. In approaches, the reaction can be carried out at temperatures from about 100° C. to about 200° C., pressures from about 250 to about 1,000 psi, and for reaction times of about 2 to about 30 hours as needed to achieve the desired sulfur levels for each additive of the mixture.

The reaction can be carried with or without a catalyst. If used, suitable catalysts may include amines and sulfur compounds such as dithiocarbamate salts and mercaptans such as, but not limited to, n-butylamine, n-octylamine, triethylamine, tetramethylthiuram disulfide, and mercaptobenzothiazole, and the like. The catalysts may be used, if needed, in amounts of about 0.01 to about 5.0 weight percent of the reaction mixture or other amounts suitable for the particular application and sulfur levels. The reaction may be carried out in the absence of oxygen.

The above sulfurized olefin or sulfurized hydrocarbyl intermediate may then be treated with an aqueous solution of caustic and/or alkali metal sulfide, such as sodium or potassium sulfide and, in some instances, sodium sulfide, which can be prepared, for example, by mixing aqueous sodium hydrosulfide and caustic solutions (such as aqueous sodium hydroxide) in amounts effective to produce the desired sulfide profiles/ratios of each reaction product. The solution can contain co-solvents such as methanol. The sodium sulfide solution and the sulfurized intermediate may be combined in a stirred reactor and heated under an inert atmosphere such as nitrogen at temperatures up to about 100° C., such as about 50° to about 100° C. for about 30 minutes to about 4 hours and, in some instances, about 1 to about 2 hours. The reaction mixture is then allowed to cool and the organic product separated on top of the aqueous layer may be recovered. The amount of caustic may be varied as needed to form each of the reaction products and sulfur profiles/ratios thereof. That is, the first reaction product having a high level of $S_3$ sulfur groups may be processed with higher levels of caustic and the second reaction product having a balanced mix of $S_3$ and $S_4$ groups may be processed with lower amounts of caustic. In one embodiment, the first reaction product is processed with at least 2x the amount of caustic than the second reaction product.

The organic sulfide compounds of the final lubricating compositions herein (that is, all reaction products combined) may include about 12 to about 20 weight percent organic sulfide compounds with an $S_2$ moiety (in other approaches, about 12 to about 16 weight percent), about 60 to about 75 weight percent of organic sulfide compounds with a $S_3$ moiety (in other approaches, about 65 to about 75 weight percent), about 12 to about 20 weight percent of organic sulfide compounds with an S4 moiety (in other approaches, about 12 to about 18 weight percent), about 0.5 to about 5 weight percent of organic sulfide compounds with an $S_5$ moiety (in other approaches, about 0.5 to about 3 weight percent), and no more than about 1 weight percent of organic sulfide compounds having an $S_6$ moiety (in other approaches, no more than about 0.5 weight percent or no functional amounts). This total organic sulfide compounds are preferably provided by at least two reaction products of different organic sulfide combinations. In another approach, the organic sulfide compounds in the final lubricating compositions may have select weight ratios of the $S_3$ moieties to the $S_4$ moieties, such as a weight ratio of $S_3$ to $S_4$ moieties of about 3:1 to about 6:1 (in other approaches, about 4:1 to about 5.5:1).

In any embodiment herein, the first reaction product of organic sulfide compounds includes high amounts of compounds with a $S_3$ moiety and, preferably, includes a combination of organic sulfide compounds with about 12 to 18 about weight percent organic sulfide compounds with an $S_2$ moiety (in other embodiments, about 12 to about 16 weight percent), about 70 to about 90 weight percent of organic sulfide compounds with a $S_3$ moiety (in other embodiments, about 80 to about 90 weight percent), about 1 to about 6 weight percent of organic sulfide compounds with an $S_4$ moiety (in other embodiments, about 2 to about 5 weight percent), no more than about 1 weight percent of organic sulfide compounds with an S5 moiety (in other embodiments, no more than about 0.5 weight percent or no functional amounts), and no more than about 1 weight percent of organic sulfide compounds having an $S_6$ moiety (in other embodiments, no more than about 0.5 weight percent or no functional amounts). In other approaches, the first reaction product of organic sulfide compounds may have a weight ratio of $S_3$ to $S_4$ moieties of about 20:1 to about 30:1 (in other approaches, about 25:1 to about 30:1).

In any embodiment herein, the second reaction product of organic sulfide compounds includes a more balanced blend of compounds with a $S_3$ and $S_4$ moieties and, preferably, includes a combination of organic sulfide compounds with about 12 to about 18 percent organic sulfide compounds with an $S_2$ moiety (in other embodiments, about 12 to about 16 weight percent), about 50 to about 60 weight percent of organic sulfide compounds with a $S_3$ moiety (in other embodiments, about 55 to about 60 weight percent), about 20 to about 30 weight percent of organic sulfide compounds with an $S_4$ moiety (in other embodiments, about 20 to about 26 weight percent), about 1 to about 5 weight percent of organic sulfide compounds with an S5 moiety (in other embodiments, about 1 to about 4 weight percent), and no more than about 1 weight percent of organic sulfide compounds having an $S_6$ moiety (in other embodiments, no more than about 0.5 weight percent or no functional amounts). In other approaches, the second reaction product of organic sulfide compounds may have a weight ratio of $S_3$ to $S_4$ moieties of about 1.5:1 to about 4:1 (in other approaches, about 2:1 to about 3:1).

In yet other approaches or embodiments, the lubricating compositions herein may include treat rates of the organic sulfide compounds provided by (1) about 1.5 to about 2.8 weight percent of the first reaction product of organic sulfide compounds (in other approaches, about 1.6 to about 2.2 weight percent), and (2) about 1.5 to about 2.8 weight percent of the second reaction product of organic sulfur compounds (in other approaches, about 1.6 to about 2.2 weight percent). Of course, the amounts of each reaction product will depend on the make-up of the sulfur compounds within each reaction product. In some approaches, it is preferred that the final fluid include no more than 3 weight percent of sulfur compounds with $S_5$ sulfur groups, greater than about 60 weight percent of sulfur compounds with $S_3$ groups, and/or less than 20 weight percent of sulfur compounds with $S_4$ groups. In yet other approaches, the lubricating compositions may have a weight ratio of the first organic sulfide reaction product to the second organic sulfide reaction product of about 0.8:1 to about 1:0.8.

As shown in the Examples below, selecting specific combinations of the organic sulfide reaction products aids in achieving good friction performance, good wear scar performance, and good copper corrosion performance. Moreover, high levels of sulfur typically is detrimental to copper corrosion, but when the lubricating compositions herein include the specific profile/ratios of organic sulfur compounds, the compositions can surprisingly include higher levels of total sulfur yet achieve better copper corrosion performance than comparative fluids having lower levels of sulfur but not falling with the certain sulfur profiles identified herein.

Thiadiazole Additive

The lubricating compositions herein may also include a thiadiazole or derivative thereof. In approaches, the lubricating compositions may include about 0.1 weight percent or more of the thiadiazole or derivative thereof In some approaches, the lubricating compositions may include about 0.1 weight percent to about 1 weight percent, or about 0.1 weight to about 0.5 weight percent of the thiadiazole or derivative thereof. In some embodiments, the thiadiazole or derivative thereof may be a mixture of thiadiazole compounds and/or hydrocarbyl-substituted derivatives thereof.

In some approaches, the thiadiazole or derivative thereof provides at least about 350 ppm sulfur to the lubricating composition, in other approaches, at least about 380 ppm sulfur, at least about 400 ppm sulfur, at least about 500 ppm sulfur, at least about 600 ppm sulfur, or at least about 700 ppm sulfur to about 2500 ppm or less, about 2000 ppm or less, about 1500 ppm or less, or about 1000 ppm or less.

In approaches, the thiadiazole or derivative thereof includes one or more compounds having a structure of Formula I:

(Formula I)

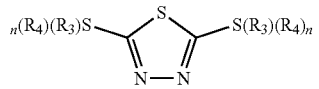

wherein each $R_3$ is independently hydrogen or sulfur, each $R_4$ is independently an alkyl group, n is an integer of 0 or 1 and if $R_3$ is hydrogen then the integer n of the adjacent $R_4$ moiety is 0 and if $R_3$ is sulfur then the n of the adjacent $R_4$ moiety is 1, and with the proviso that at least one $R_3$ is sulfur. In other approaches, the thiadiazole additive is a blend of compounds of Formula Ia and Formula Ib shown below:

(Formula Ia)

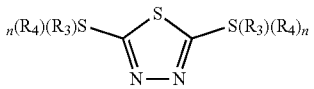

wherein within Formula Ia each integer n is 1, each $R_3$ is sulfur, and each $R_4$ is a C5 to C15 alkyl group, preferably a C8 to C12 alkyl group; and (Formula Ib)

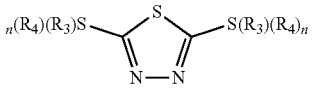

wherein within Formula Ib one integer n is 1 with the associated $R_4$ group being a C5 to C15 alkyl group (preferably a C8 to C12 alkyl group) and the associated $R_3$ group being sulfur and the other integer n is 0 with the associated $R_3$ group being hydrogen. In some embodiments, the thiadiazole or derivative thereof includes a blend of Formula Ia and Ib with Formula Ia being a majority of the blend and in other approaches, the blend of Ia and Ib is about 75 to about 90 weight percent of Ia and about 10 to about 25 weight percent of Ib (or other ranges therewithin). In another approach, the thiadiazole is a 2,5 dimercapto 1,3,4 thiadiazole including a blend of 2,5-bis-(nonyldithio)-1,3,4-thiadiazole (such as about 75 to about 90%) and 2,5-mono-(nonyldithio)-1,3,4-thiadiazole (such as about 10 to about 25%).

In other approaches or embodiments, examples of the thiadiazole compounds that may be used in the fluids herein include 2-mercapto-5-hydrocarbylthio-1,3,4-thiadiazole; 2-mercapto-5-hydrocarbyldithio-1,3,4-thiadiazole; 2,5-bis (hydrocarbylthio)-1,3,4-thiadiazole; 2,5-bis(hydrocarbyldithio)-1,3,4-thiadiazoles, variations thereof, or combinations thereof. The 1,3,4-thiadiazoles are generally synthesized from hydrazine and carbon disulfide by known procedures. See, for example, U.S. Pat. Nos. 2,765, 289; 2,749,311; 2,760,933; 2,850,453; 2,910,439; 3,663,561; 3,862,798; and 3,840,549, which are incorporated herein by reference.

Phosphorus Containing Friction Modifier

The lubricating compositions herein may also be treated with or include phosphorus-containing friction modifiers in the form of one or more phosphonate monoesters and, in particular, one or more hydrocarbyl phosphonate monoesters. In some approaches, the hydrocarbyl phosphonate monoesters have a structure of Formula II (Formula II)

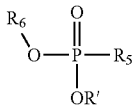

wherein $R_5$, the hydrocarbyl moiety, is a linear or branched C12 to C30 hydrocarbyl chain; $R_6$, the monoester moiety, is a linear or branched C1 to C4 alkyl group; and R' is hydrogen or an alkyl group such as a C1 to C30 alkyl group. In alternative approaches, $R_6$ is a methyl or ethyl group. The amount of the phosphonate monoester, such as the hydrocarbyl phosphonate monoesters described herein, is about 0.1 to about 1 weight percent based on a total weight of the lubricating oil composition, in other approaches, about 0.1 to about 0.7 percent, in yet further approaches, or about 0.1 to about 0.5 weight percent.

Suitable phosphonates may also include primary alkyl acyclic hydrocarbyl phosphonates in which the primary alkyl group includes 1 to 4 carbon atoms and in which the acyclic hydrocarbyl group bonded to the phosphorus atom contains 12 to 30 carbon atoms and, in some approaches, is a linear hydrocarbyl group free of acetylenic unsaturation. In other approaches, the acyclic hydrocarbyl group includes 12 to 24 carbon atoms, and in yet further approaches, 12 to 20 carbon atoms.

Exemplary phosphonate compounds for the friction modifiers herein include methyl hydrocarbyl phosphonates, ethyl hydrocarbyl phosphonates, propyl hydrocarbyl phosphonates, butyl hydrocarbyl phosphonates, iso-butyl hydrocarbyl phosphonates, and wherein, in each case, the hydrocarbyl group is preferably linear, saturated, or contains one or more olefinic double bonds with each double bond preferably being an internal double bond. Other suitable compounds include those in which the hydrocarbyl group bonded to the phosphorus atom contains 16 to 20 carbon atoms or 18 to 20 carbon atoms. A particularly suitable phosphonate monoester compound may be ethyl octadecyl phosphonate or methyl octadecyl phosphonate. Other examples of suitable phosphonate monoesters include, but are not limited to, methyl triacontyl phosphonate, methyl triacontenyl phosphonate, methyl eicosyl phosphonate, methyl hexadecyl phosphonate, methyl hexadecenyl phosphonate, methyl tetracontenyl phosphonate, methyl hexacontyl phosphonate, methyl dodecyl phosphonate, methyl dodecenyl phosphonate, ethyl triacontyl phosphonate, ethyl triacontenyl phosphonate, ethyl eicosyl phosphonate, ethyl hexadecyl phosphonate, ethyl hexadecenyl phosphonate, ethyl tetracontenyl phosphonate, ethyl hexacontyl phosphonate, ethyl dodecyl phosphonate, ethyl dodecenyl phosphonate, and the like compounds, and mixtures thereof.

In some instances, the phosphonate monoester may drop out of solution or result in a small amount of precipitate. In this instance, while the precipitate does not impact friction, extreme performance, or copper corrosion, it may be aesthetically undesired. If needed, amounts of a solubilizing amine, amine phosphate, or salt thereof may be employed to aid in the solubility of the phosphonate monoester, and a wide variety of solubilizing amines may be provided for such purpose. If needed, about 0.1 to about 0.5 weight percent, in other approaches, about 0.15 to about 0.4 weight percent, and in yet other approaches, about 0.2 to about 0.3 weight percent of the solubilizing amine may be added along with the phosphorus friction modifier if needed to aid in solubility.

If needed, exemplary solubilizing amines may include dihydrocarbyl (mono)thiophosphate amines or salts thereof and may include those with a hydrocarbyl portion being saturated or unsaturated groups, alkyl groups, alkenyl groups and/or aromatic hydrocarbon groups of 2 to 24 carbons. In approaches, hydrocarbyl amines may be used for the solubilizing amines or amine salts herein. These amines may be primary hydrocarbyl amines containing 4 to 30 carbon atoms. Fatty amines may also be used and may include alkyl amines such as n-hexylamine, n-octylamine, n-decylamine, n-dodecylamine, n-tetradecylamine, n-pentadecylamine, n-hexadecylamine, n-octadecylamine (stearyl amine), and the like.

In yet other approaches, suitable solubilizing amine salts may be those derived from tertiary-aliphatic primary amines having 4 to 30 carbon atoms in the alkyl group. Mixtures of amines may also be beneficial, such as mixtures of C11-C14 tertiary alkyl primary amines and/or mixtures of C18-C22 tertiary alkyl primary amines. For instance, one suitable solubilizing amine may be a dithiopohosphate ester amine or salt thereof prepared by reacting an O,O'-di (4-methyl-2-pentanyl) phosphorodithioic acid with ethylene and/or propylene oxide to provide a first reaction product, further reacting the first reaction product with phosphorus pentoxide to provide a second reaction product, and then neutralizing the second reaction product with one or more tertiary aliphatic primary amines to provide the solubilizing amine. The one or more tertiary aliphatic primary amines may be a mixture of C11 to C14 tertiary alkyl primary amines.

The lubricating compositions herein may also be free of or substantially free of certain other phosphorus friction modifiers. While not wishing to be limited by theory, it is believed that phosphonate diesters, such as dialkyl hydrocarbyl phosphonate (and in particular dimethyl octadecyl phosphonate), may negatively impact copper corrosion. It is believed, for instance, that such phosphonate diesters may react or interact with the thiadiazole additives of the compositions herein leading to undesired reaction products or other impurities that may degrade copper corrosion. To this end, the lubricating compositions herein may be, in some approaches or embodiments, free of or substantially free of phosphonate diesters, such as less than about 0.8 weight percent, less than 0.5 weight percent, less, than about 0.25 weight percent, less than about 0.1 weight percent, or include no functional amounts of phosphonate diesters.

Base Oil

In one approach, suitable base oils for use in the lubricating composition or gear fluids herein include mineral oils, synthetic oils, and include all common mineral oil basestocks. The mineral oil may be naphthenic or paraffinic. The mineral oil may be refined by conventional methodology using acid, alkali, and clay or other agents such as aluminium chloride, or may be an extracted oil produced, e.g. by solvent extraction with solvents such as phenol, sulfur dioxide, furfural or dichlorodiethyl ether. The mineral oil may be hydrotreated or hydrofined, dewaxed by chilling or catalytic dewaxing processes, or hydrocracked, such as the Yubase ® family of hydrockracked base oils from SK Innovation Co., Ltd. (Seoul, Korea). The mineral oil may be produced from natural crude sources or be composed of isomerized wax materials or residues of other refining processes.

The base oil or base oil of lubricating viscosity used in the compositions herein may be selected from any suitable base oil for driveline or gear oil applications. Examples include the base oils in Groups I-V as specified in the American Petroleum Institute (API) Base Oil Interchangeability Guidelines. These three base oil groups are as follows:

TABLE 1

| Base oil Types | | | | |
|---|---|---|---|---|
| Base Oil Category | Sulfur (%) | | Saturates (%) | Viscosity Index |
| Group I | >0.03 | and/or | <90 | 80 to 120 |
| Group II | ≤0.03 | and | ≥90 | 80 to 120 |
| Group III | ≤0.03 | and | ≥90 | ≥120 |
| Group IV | All polyalphaolefins (PAOs) | | | |
| Group V | All others not included in Groups I, II, III, or IV | | | |

Groups I, II, and III are mineral oil process stocks and may be preferred for the driveline or gear fluids of the present application. It should be noted that although Group III base oils are derived from mineral oil, the rigorous processing that these fluids undergo causes their physical properties to be very similar to some true synthetics, such as PAOs. Therefore, oils derived from Group III base oils may be referred to as synthetic fluids in the industry. Suitable oils may be derived from hydrocracking, hydrogenation, hydrofinishing, unrefined, refined, and re-refined oils, and mixtures thereof. In some approaches, the base oil may be a blend of Group I and Group II oils and the blend may be about 0% to about 100% of the Group I oil, about 0% to about 100% of the Group II oil, about 0% to about 100% of the Group III oil, or various blends of Group I and II, Group I and III, or Group II and III oil blends.

Unrefined oils are those derived from a natural, mineral, or synthetic source without or with little further purification treatment. Refined oils are similar to the unrefined oils except that they have been treated in one or more purification steps, which may result in the improvement of one or more properties. Examples of suitable purification techniques are solvent extraction, secondary distillation, acid or base extraction, filtration, percolation, and the like. Oils refined to the quality of an edible may or may not be useful. Edible oils may also be called white oils. In some embodiments, lubricating oil compositions are free of edible or white oils.

Re-refined oils are also known as reclaimed or reprocessed oils. These oils are obtained similarly to refined oils using the same or similar processes. Often these oils are additionally processed by techniques directed to removal of spent additives and oil breakdown products.

Mineral oils may include oils obtained by drilling or from plants and animals or any mixtures thereof. For example such oils may include, but are not limited to, castor oil, lard oil, olive oil, peanut oil, corn oil, soybean oil, and linseed oil, as well as mineral lubricating oils, such as liquid petroleum oils and solvent-treated or acid-treated mineral lubricating oils of the paraffinic, naphthenic or mixed paraffinic-naphthenic types. Such oils may be partially or fully hydrogenated, if desired. Oils derived from coal or shale may also be useful.

The major amount of base oil included in the gear fluids herein may be selected from the group consisting of Group I, Group II, a Group III, and a combination of two or more of the foregoing, and wherein the major amount of base oil is other than base oils that arise from provision of additive components or viscosity index improvers in the composition. In another embodiment, the major amount of base oil included in a lubricating composition may be selected from the group consisting of Group I, a Group II, and a combination of two or more of the foregoing, and wherein the major amount of base oil is other than base oils that arise from provision of additive components or viscosity index improvers in the composition.

The base oil may also be any of the synthetic base oils. Useful synthetic lubricating oils may include hydrocarbon oils such as polymerized, oligomerized, or interpolymerized olefins (e.g., polybutylenes, polypropylenes, propyleneisobutylene copolymers); poly(1-hexenes), poly(1-octenes), trimers or oligomers of 1-decene, e.g., poly(l-decenes), such materials being often referred to as a-olefins, and mixtures thereof; alkyl-benzenes (e.g. dodecylbenzenes, tetradecylbenzenes, dinonylbenzenes, di-(2-ethylhexyl)-benzenes); polyphenyls (e.g., biphenyls, terphenyls, alkylated polyphenyls); diphenyl alkanes, alkylated diphenyl alkanes, alkylated diphenyl ethers and alkylated diphenyl sulfides and the derivatives, analogs and homologs thereof or mixtures thereof. Polyalphaolefins are typically hydrogenated materials.

Other synthetic lubricating oils include polyol esters, diesters, liquid esters of phosphorus-containing acids (e.g., tricresyl phosphate, trioctyl phosphate, and the diethyl ester of decane phosphonic acid), or polymeric tetrahydrofurans. Synthetic oils may be produced by Fischer-Tropsch reactions and typically may be hydroisomerized Fischer-Tropsch hydrocarbons or waxes. In one embodiment oils may be prepared by a Fischer-Tropsch gas-to-liquid synthetic procedure as well as other gas-to-liquid oils.

The amount of the base oil of lubricating viscosity in the compositions herein may be the balance remaining after subtracting from 100 wt% the sum of the amount of the performance additives. For example, the oil of lubricating viscosity that may be present in a finished fluid may be a "major amount," such as greater than about 50 wt%, greater than about 60 wt%, greater than about 70 wt%, greater than about 80 wt%, greater than about 85 wt%, greater than about 90 wt%, or greater than about 95 wt%.

In some approaches, a preferred base oil or base oil of lubricating viscosity has less than about 25 ppm sulfur, a viscosity index greater than about 120 ppm, and a kinematic viscosity at about 100° C. of about 2to about8 cSt. In other approaches, the base oil of lubricating viscosity has less than about 25 ppm sulfur, a viscosity index greater than 120, and a kinematic viscosity at 100° C. of about 4 cSt. The base oil may have CP (paraffinic carbon content) of greater than 40%, greater than 45%, greater than 50%, greater than 55%, or greater than 90%. The base oil may have a CA (aromatic carbon content) of less than 5%, less than 3%, or less than 1%. The base oil may have a CN (naphthenic carbon content) of less than 60%, less than 55%, less than 50%, or less than 50% and greater than 30%. The base oil may have a ratio of 1 ring naphthenes to 2-6 ring naphthenes of less than 2 or less than 1.5 or less than 1.

A suitable driveline or gear lubricant composition herein may include additive components in the ranges listed in the following Table 2.

TABLE 2

Suitable and Preferred Driveline or Gear Fluid Compositions

| Component | wt % (Suitable Embodiments) | wt % (Other Embodiments) |
|---|---|---|
| First organic sulfide reaction product | 1.5-3.2 | 1.6-2.2 |
| Second organic sulfide reaction product | 1.5-3.2 | 1.6-2.2 |
| Thiadiazole or derivative thereof | 0.1-1.0 | 0.1-0.5 |
| Phosphorous containing friction modifier | 0.1-1.0 | 0.1-1.0 |
| Antioxidant(s) | 0.1-5.0 | 0.01-4.0 |
| Detergent(s) | 0.0-15.0 | 1.0-8.0 |
| Corrosion inhibitor(s) | 0.0-5.0 | 0.1-3.0 |
| Ash-free phosphorus compound(s) | 0.0-15.0 | 0.1-5.0 |
| Antifoaming agent(s) | 0.0-1.0 | 0.001-0.5 |
| Antiwear agent(s) | 0.0-1.0 | 0.0-0.8 |
| Pour point depressant(s) | 0.0-1.0 | 0.01-0.5 |
| Viscosity index improver(s) | 0.0-20.0 | 0.1-10.0 |
| Dispersants | 0.0-10.0 | 1.0-6.0 |
| Dispersant viscosity index improver(s) | 0.0-10.0 | 0.0-5.0 |
| Friction modifier(s) | 0.0-10.0 | 0.01-4.0 |
| Extreme Pressure Agent | 0.0-1.05 | 0.035-.35 |
| Base oil(s) | Balance | Balance |
| Total | 100 | 100 |

The percentages of each component above represent the weight percent of each component, based upon the weight of the total final additive or lubricating oil composition. The balance of the lubricating oil composition consists of one or more base oils or solvents. Additives used in formulating the compositions described herein may be blended into the base oil or solvent individually or in various sub-combinations. However, it may be suitable to blend all of the components concurrently using an additive concentrate (i.e., additives plus a diluent, such as a hydrocarbon solvent).

The lubricating composition described herein may be formulated to provide lubrication, enhanced friction performance properties, and improved copper corrosion for various applications. The driveline lubricating compositions herein may be used for lubricating a machine part, such as a gear. Lubricating fluids according to the present disclosure can be used in gear applications, such as industrial gear applications, automotive gear applications, axles, and stationary gearboxes. Gear-types can include, but are not limited to, spur, spiral, worm, rack and pinion, involute, bevel, helical, planetary, and hypoid gears and as well as limited-slip applications and differentials. The driveline lubricating compositions disclosed herein are also suitable for automatic or manual transmissions, including step automatic transmissions, continuously variable transmissions, semi-automatic transmissions, automated manual transmissions, toroidal transmissions, and dual clutch transmissions. The driveline lubricating compositions herein are particularly suited for use in axles, transfer cases, differentials, such as straight differentials, turning differentials, limited-slip differentials, clutch-type differentials, and locking differentials, and the like.

Optional Additives

In other approaches, the lubricant including such additives noted above may also include one or more optional components so long as such components and amounts thereof do not impact the performance characteristics as described in the above paragraphs. These optional components are described in the following paragraphs.

Other Phosphorus-Containing Compounds

The lubricant composition herein may comprise one or more phosphorus-containing compounds that may impart anti-wear benefits to the fluid. The one or more phosphorus-containing compounds may be present in the lubricating oil composition in an amount ranging from about 0 wt% to about 15 wt%, or about 0.01 wt% to about 10 wt%, or about 0.05 wt% to about 5 wt%, or about 0.1 wt% to about 3 wt% of the lubricating oil composition. The phosphorus-containing compound may provide up to 5000 ppm phosphorus, or from about 50 to about 5000 ppm phosphorus, or from about 300 to about 1500 ppm phosphorus, or up to 600 ppm phosphorus, or up to 900 ppm phosphorus to the lubricant composition.

The one or more phosphorus-containing compounds may include ashless phosphorus-containing compounds. Examples of suitable phosphorus-containing compound include, but are not limited to, thiophosphates, dithiophosphates, phosphates, phosphoric acid esters, phosphate esters, phosphites, phosphonates, phosphorus-containing carboxylic esters, ethers, or amides salts thereof, and mixtures thereof. Phosphorus containing anti-wear agents are more fully described in European Patent 0612839.

It should be noted that often the term phosphonate and phosphite are used often interchangeably in the lubricant industry. For example, dibutyl hydrogen phosphonate is often referred to as dibutyl hydrogen phosphite. It is within the scope of the present invention for the inventive lubricant composition to include a phosphorus-containing compound that may be referred to as either a phosphite or a phosphonate.

In any of the above described phosphorus-containing compounds, the compound may have about 5 to about 20 weight percent phosphorus, or about 5 to about 15 weight percent phosphorus, or about 8 to about 16 weight percent phosphorus, or about 6 to about 9 weight percent phosphorus.

The inclusion of the phosphorus-containing compound in combination with the above described dispersant to a lubricant compositions unexpectedly imparts positive frictional characteristics, such as a low friction coefficient, to the lubricant composition. The inventive effect is even further pronounced in some cases where the phosphorus-containing compound, on its own, imparts negative frictional characteristics to the fluid. When these relatively poor friction reducing phosphorus-containing compounds are combined with the olefin copolymer dispersant described herein, the lubricant composition has an improved, i.e., lower, friction coefficient. That is, the dispersants herein tend to transform fluids containing phosphorus-containing compounds having relatively poor friction coefficients into fluids with improved frictional properties.

This improvement in frictional properties of the lubricating compositions including the phosphorus-containing compounds and the olefin copolymer dispersant described herein is surprising because the frictional properties of the fluid are better than combinations of the phosphorus-containing compounds in combination with other types of dispersants, including polyisobutylene succinimide dispersants and olefin copolymer succinimide dispersants that do not have the specified characteristics of the copolymers described above.

Another type of phosphorus-containing compound that when combined with the olefin copolymer dispersant herein imparts improved frictional characteristics to a lubricating composition is an ashless (metal free) phosphorus-containing compound.

In some embodiments, the ashless phosphorus-containing compound may be dialkyl dithiophosphate ester, amyl acid phosphate, diamyl acid phosphate, dibutyl hydrogen phosphonate, dimethyl octadecyl phosphonate, salts thereof, and mixtures thereof.

The ashless phosphorus-containing compound may be have the formula:

(Formula XIV)

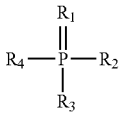

wherein R1 is S or O; R2 is -OR, -OH, or -R"; R3 is -OR", -OH, or SR"'C(O)OH; R4 is -OR"; R'' is C1 to C3 branched or linear alkyl chain; and R" is a C1 to C18 hydrocarbyl chain. When the phosphorous-containing compound has the structure shown in Formula XIV, the compound may have about 8 to about 16 weight percent phosphorus.

In some embodiments the lubricant composition comprises a phosphorus-containing compound of Formula XIV wherein R1 is S; R2 is -OR"; R3 is S R"COOH; R4 is -OR"; R"'is C3 branched alkyl chain; R" is C4; and wherein the phosphorus-containing compound is present in an amount to deliver between 80-900 ppm phosphorus to the lubricant composition.

In another embodiment, the lubricant composition comprises a phosphorus-containing compound of Formula XIV wherein R1 is O; R2 is -OH; R3 is -OR" or -OH; R4 is -OR"; R" is C5; and wherein phosphorus-containing compound is present in an amount to deliver between 80-1500 ppm phosphorus to the lubricant composition.

In yet another embodiment, the lubricant composition comprises a phosphorus-containing compound of Formula XIV wherein R1 is O; R2 is OR"; R3 is H; R4 is -OR"; R" is C4; and wherein the one or more phosphorus-containing compound(s) is present in an amount to deliver between 80-1550 ppm phosphorus to the lubricant composition.

In other embodiments, the lubricant composition comprises a phosphorus-containing compound of Formula XIV wherein R1 is 0; R2 is -R"; R3 is -OCH3 or -OH; R4 is -OCH3; R" is C18; and wherein the one or more phosphorus-containing compound(s) is present in an amount to deliver between 80-850 ppm phosphorus to the lubricant composition.

In some embodiments, the phosphorus-containing compound has the structure shown in Formula XIV and delivers about 80 to about 4500 ppm phosphorus to the lubricant composition. In other embodiments, the phosphorus-containing compound is present in an amount to deliver between about 150 and about 1500 ppm phosphorus, or between about 300 and about 900 ppm phosphorus, or between about 800 to 1600 ppm phosphorus, or about 900 to about 1800 ppm phosphorus, to the lubricant composition.

Other Anti-wear Agents

The lubricant composition may also include other antiwear agents that are non-phosphorus-containing compounds. Examples of such antiwear agents include borate esters, borate epoxides, thiocarbamate compounds (including thiocarbamate esters, alkylene-coupled thiocarbamates, and bis(S-alkyldithiocarbamyl)disulfides, thiocarbamate amides, thiocarbamic ethers, alkylene-coupled thiocarbamates, and bis(S-alkyldithiocarbamyl) disulfides, and mixtures thereof), sulfurized olefins, tridecyl adipate, titanium compounds, and long chain derivatives of hydroxyl carboxylic acids, such as tartrate derivatives, tartramides, tartrimides, citrates, and mixtures thereof. A suitable thiocarbamate compound is molybdenum dithiocarbamate. Suitable tartrate derivatives or tartrimides may contain alkyl-ester groups, where the sum of carbon atoms on the alkyl groups may be at least 8. The tartrate derivative or tartrimide may contain alkyl-ester groups, where the sum of carbon atoms on the alkyl groups may be at least 8. The antiwear agent may in one embodiment include a citrate. The additional anti-wear agent may be present in ranges including about 0 wt% to about 15 wt%, or about 0.01 wt% to about 10 wt%, or about 0.05 wt% to about 5 wt%, or about 0.1 wt% to about 3 wt% of the lubricating oil composition.

Other Extreme Pressure Agents

The lubricant compositions of the disclosure may also contain other extreme pressure agent(s) so long as the lubricating compositions herein include the noted amounts and profiles set forth herein. The optional extreme pressure agent may contain sulfur and may contain at least 12 percent by weight sulfur. In some embodiments, the extreme pressure agent added to the lubricating oil is sufficient to provide at least 350 ppm sulfur, 500 ppm sulfur, 760 ppm sulfur, from about 350 to about 2,000 ppm sulfur, from about 2,000 to about 30,000 ppm sulfur, or from about 2,000 to about 4,800 ppm sulfur, or about 4,000 to about 25,000 ppm sulfur to the lubricant composition.

A wide variety of sulfur-containing extreme pressure agents are suitable and include sulfurized animal or vegetable fats or oils, sulfurized animal or vegetable fatty acid esters, fully or partially esterified esters of trivalent or pentavalent acids of phosphorus, sulfurized olefins (see, for example U.S. Pat. Nos. 2,995,569; 3,673,090; 3,703,504; 3,703,505; 3,796,661; 3,873,454 4,119,549; 4,119,550; 4,147,640; 4,191,659; 4,240,958; 4,344,854; 4,472,306; and 4,711,736), dihydrocarbyl polysulfides (see for example U.S. Pat. Nos. 2,237,625; 2,237,627; 2,527,948; 2,695,316; 3,022,351; 3,308,166; 3,392,201; 4,564,709; and British 1,162,334), functionally-substituted dihydrocarbyl polysulfides (see for example U.S. Pat. No. 4,218,332), and polysulfide olefin products (see for example U.S. Pat. No. 4,795,576). Other suitable examples include organo-sulfur compounds selected from sulfurized olefins, sulfur-containing amino heterocyclic compounds, 5-dimercapto-1,3,4-thiadiazole, polysulfides having a majority of S3 and S4 sulfides, sulfurized fatty acids, sulfurized branched olefins, organic polysulfides, and mixtures thereof.

In some embodiments the extreme pressure agent is present in the lubricating composition in an amount of up to about 3.0 wt% or up to about 5.0 wt%. In other embodiments, the extreme pressure agent is present from about 0.05 wt% to about 0.5 wt%, based on the total lubricant composition. In other embodiments, the extreme pressure agent is present from about 0.1 wt% to about 3.0 wt%, based on the total lubricant composition. In other embodiments the extreme pressure agent is present in an amount between about 0.6 wt% and about 1 wt%, based on the total lubricant composition. In yet other embodiments, the detergent is present in an amount of about 1.0 wt%, based on the total lubricant composition.

One suitable class of extreme pressure agents are polysulfides composed of one or more compounds represented by the formula: Ra—Sx—Rb where Ra and Rb are hydrocarbyl groups each of which may contain 1 to 18, and in other approaches, 3 to 18 carbon atoms and x is may be in the range of from 2 to 8, and typically in the range of from 2 to 5, especially 3. In some approaches, x is an integer from 3 to 5 with about 30 to about 60 percent of x being an integer of 3 or 4. The hydrocarbyl groups can be of widely varying types such as alkyl, cycloalkyl, alkenyl, aryl, or aralkyl. Tertiary alkyl polysulfides such as di-tert-butyl trisulfide, and mixtures comprising di-tert-butyl trisulfide (e.g., a mixture composed principally or entirely of the tri, tetra-, and pentasulfides) may be used. Examples of other useful dihydrocarbyl polysulfides include the diamyl polysulfides, the dinonyl polysulfides, the didodecyl polysulfides, and the dibenzyl polysulfides.

Another suitable class of extreme pressure agent is sulfurized isobutenes made by reacting an olefin, such as isobutene, with sulfur. Sulfurized isobutene (SIB), notably sulfurized polyisobutylene, typically has a sulfur content of from about 10 to about 55%, desirably from about 30 to about 50% by weight. A wide variety of other olefins or unsaturated hydrocarbons, e.g., isobutene dimer or trimer, may be used to form the sulfurized olefin extreme pressure agents. Various methods have been disclosed in the prior art for the preparation of sulfurized olefins. See, for example, U.S. Pat. No. 3,471,404 to Myers; U.S. Pat. No. 4,204,969 to Papay et al.; U.S. Pat. No. 4,954,274 to Zaweski et al.; U.S. Pat. No. 4,966,720 to DeGonia et al.; and U.S. Pat. No. 3,703,504 to Horodysky, et al, each of which his incorporated herein by reference.

Methods for preparing sulfurized olefins, including the methods disclosed in the aforementioned patents, generally involve formation of a material, typically referred to as an adduct", in which an olefin is reacted with a sulfur halide, for example, sulfur monochloride. The adduct is then reacted with a sulfur source to provide the sulfurized olefin. The quality of a sulfurized olefin is generally measured by various physical properties, including, for example, viscosity, sulfur content, halogen content and copper corrosion test weight loss. U.S. Patent No. 4,966,720, relates to sulfurized olefins useful as extreme pressure additives in lubrication oils and to a two stage reaction for their preparation.

Antioxidants

The lubricating oil compositions herein also may optionally contain one or more antioxidants. Antioxidant compounds are known and include for example, phenates, phenate sulfides, sulfurized olefins, phosphosulfurized terpenes, sulfurized esters, aromatic amines, alkylated diphenylamines (e.g., nonyl diphenylamine, di-nonyl diphenylamine, octyl diphenylamine, di-octyl diphenylamine), phenyl-alpha-naphthylamines, alkylated phenyl-alpha-naphthylamines, hindered non-aromatic amines, phenols, hindered phenols, oil-soluble molybdenum compounds, macromolecular antioxidants, or mixtures thereof. Antioxidant compounds may be used alone or in combination.

The hindered phenol antioxidant may contain a secondary butyl and/or a tertiary butyl group as a sterically hindering group. The phenol group may be further substituted with a hydrocarbyl group and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butylphenol or 4-butyl-2,6-di-tert-butylphenol, or 4-dodecyl-2,6-di-tert-butylphenol. In one embodiment the hindered phenol antioxidant may be an ester and may include, e.g., Irganox® L-135 available from BASF or an addition product derived from 2,6-di-tert-butylphenol and an alkyl acrylate, wherein the alkyl group may contain about 1 to about 18, or about 2 to about 12, or about 2 to about 8, or about 2 to about 6, or about 4 carbon atoms. Another commercially available hindered phenol antioxidant may be an ester and may include Ethanox® 4716 available from Albemarle Corporation.

Useful antioxidants may include diarylamines and phenols. In an embodiment, the lubricating oil composition may contain a mixture of a diarylamine and a phenol, such that each antioxidant may be present in an amount sufficient to provide up to about 5 wt%, based on the weight of the lubricant composition. In an embodiment, the antioxidant may be a mixture of about 0.3 wt% to about 1.5 wt% diarylamine and about 0.4 wt% to about 2.5 wt% phenol, based on the lubricant composition.

Examples of suitable olefins that may be sulfurized to form a sulfurized olefin include propylene, butylene, isobutylene, polyisobutylene, pentene, hexene, heptene, octene, nonene, decene, undecene, dodecene, tridecene, tetradecene, pentadecene, hexadecene, heptadecene, octadecene, nonadecene, eicosene or mixtures thereof. In one embodiment, hexadecene, heptadecene, octadecene, nonadecene, eicosene or mixtures thereof and their dimers, trimers and tetramers are especially useful olefins. Alternatively, the olefin may be a Diels-Alder adduct of a diene such as 1,3-butadiene and an unsaturated ester, such as, butylacrylate.

Another class of sulfurized olefin includes sulfurized fatty acids and their esters. The fatty acids are often obtained from vegetable oil or animal oil and typically contain about 4 to about 22 carbon atoms. Examples of suitable fatty acids and their esters include triglycerides, oleic acid, linoleic acid, palmitoleic acid or mixtures thereof. Often, the fatty acids are obtained from lard oil, tall oil, peanut oil, soybean oil, cottonseed oil, sunflower seed oil or mixtures thereof. Fatty acids and/or ester may be mixed with olefins, such as a-olefins.

The one or more antioxidant(s) may be present in ranges about 0 wt% to about 20 wt%, or about 0.1 wt% to about 10 wt%, or about 1 wt% to about 5 wt%, of the lubricating oil composition.

Dispersants

Dispersants contained in the lubricant composition may include, but are not limited to, an oil soluble polymeric hydrocarbon backbone having functional groups that are capable of associating with particles to be dispersed. Typically, the dispersants comprise amine, alcohol, amide, or ester polar moieties attached to the polymer backbone often via a bridging group. Dispersants may be selected from Mannich dispersants as described in U.S. Pat. Nos. 3,634,515, 3,697,574 and 3,736,357; ashless succinimide dispersants as described in U.S. Pat. Nos. 4,234,435 and 4,636,322; amine dispersants as described in U.S. Pat. Nos. 3,219,666, 3,565,804, and 5,633,326; Koch dispersants as described in U.S. Pat. Nos. 5,936,041, 5,643,859, and 5,627,259, and polyalkylene succinimide dispersants as described in U.S. Pat. Nos. 5,851,965; 5,853,434; and 5,792,729.

In some embodiments, the additional dispersant may be derived from a polyalphaolefin (PAO) succinic anhydride, an olefin maleic anhydride copolymer. As an example, the additional dispersant may be described as a poly-PIBSA. In another embodiment, the additional dispersant may be derived from an anhydride which is grafted to an ethylene-propylene copolymer. Another additional dispersant may be a high molecular weight ester or half ester amide.

The additional dispersant, if present, can be used in an amount sufficient to provide up to about 10 wt%, based upon the final weight of the lubricating oil composition. Another amount of the dispersant that can be used may be about 0.1 wt% to about 10 wt%, or about 0.1 wt% to about 10 wt%, or about 3 wt% to about 8 wt%, or about 1 wt% to about 6 wt%, based upon the final weight of the lubricating oil composition.

Viscosity Index Improvers

The lubricant compositions herein also may optionally contain one or more viscosity index improvers. Suitable viscosity index improvers may include polyolefins, olefin copolymers, ethylene/propylene copolymers, polyisobutenes, hydrogenated styrene-isoprene polymers, styrene/maleic ester copolymers, hydrogenated styrene/butadiene copolymers, hydrogenated isoprene polymers, alpha-olefin maleic anhydride copolymers, polymethacrylates, polyacrylates, polyalkyl styrenes, hydrogenated alkenyl aryl conjugated diene copolymers, or mixtures thereof. Viscosity index improvers may include star polymers and suitable examples are described in U.S. Publication No. 20120101017A1, which is incorporated herein by reference.

The lubricating oil compositions herein also may optionally contain one or more dispersant viscosity index improvers in addition to a viscosity index improver or in lieu of a viscosity index improver. Suitable viscosity index improvers may include functionalized polyolefins, for example, ethylene-propylene copolymers that have been functionalized with the reaction product of an acylating agent (such as maleic anhydride) and an amine; polymethacrylates functionalized with an amine, or esterified maleic anhydride-styrene copolymers reacted with an amine.

The total amount of viscosity index improver and/or dispersant viscosity index improver may be about 0 wt% to about 20 wt%, about 0.1 wt% to about 15 wt%, about 0.1 wt% to about 12 wt%, or about 0.5 wt% to about 10 wt%, about 3 wt% to about 20 wt%, about 3 wt% to about 15 wt%, about 5 wt% to about 15 wt%, or about 5 wt% to about 10 wt%, of the lubricating oil composition.

In some embodiments, the viscosity index improver is a polyolefin or olefin copolymer having a number average molecular weight of about 10,000 to about 500,000, about 50,000 to about 200,000, or about 50,000 to about 150,000. In some embodiments, the viscosity index improver is a hydrogenated styrene/butadiene copolymer having a number average molecular weight of about 40,000 to about 500,000, about 50,000 to about 200,000, or about 50,000 to about150,000. In some embodiments, the viscosity index improver is a polymethacrylate having a number average molecular weight of about 10,000 to about 500,000, about 50,000 to about 200,000, or about 50,000 to about 150,000.

Other Optional Additives

Other additives may be selected to perform one or more functions required of lubricant composition. Further, one or more of the mentioned additives may be multi-functional and provide functions in addition to or other than the function prescribed herein. The other additives may be in addition to specified additives of the present disclosure and/or may comprise one or more of metal deactivators, viscosity index improvers, ashless TBN boosters, antiwear agents, corrosion inhibitors, rust inhibitors, dispersants, dispersant viscosity index improvers, extreme pressure agents, antioxidants, foam inhibitors, demulsifiers, emulsifiers, pour point depressants, seal swelling agents and mixtures thereof. Typically, fully-formulated lubricating oil will contain one or more of these additives.

Suitable metal deactivators may include derivatives of benzotriazoles (typically tolyltriazole), dimercaptothiadiazole derivatives, 1,2,4-triazoles, benzimidazoles, 2-alkyldithiobenzimidazoles, or 2-alkyldithiobenzothiazoles; foam inhibitors including copolymers of ethyl acrylate and 2-ethylhexylacrylate and optionally vinyl acetate; demulsifiers including trialkyl phosphates, polyethylene glycols, polyethylene oxides, polypropylene oxides and (ethylene oxide-propylene oxide) polymers; pour point depressants including esters of maleic anhydride-styrene, polymethacrylates, polyacrylates or polyacrylamides.

Suitable foam inhibitors include silicon-based compounds, such as siloxane.

Suitable pour point depressants may include a polymethylmethacrylates or mixtures thereof. Pour point depressants may be present in an amount sufficient to provide from about 0 wt% to about 1 wt%, about 0.01 wt% to about 0.5 wt%, or about 0.02 wt% to about 0.04 wt% based upon the final weight of the lubricating oil composition.

Suitable rust inhibitors may be a single compound or a mixture of compounds having the property of inhibiting corrosion of ferrous metal surfaces. Non-limiting examples of rust inhibitors useful herein include oil-soluble high molecular weight organic acids, such as 2-ethylhexanoic acid, lauric acid, myristic acid, palmitic acid, oleic acid, linoleic acid, linolenic acid, behenic acid, and cerotic acid, as well as oil-soluble polycarboxylic acids including dimer and trimer acids, such as those produced from tall oil fatty acids, oleic acid, and linoleic acid. Other suitable corrosion inhibitors include long-chain alpha, omega-dicarboxylic acids in the molecular weight range of about 600 to about 3000 and alkenylsuccinic acids in which the alkenyl group contains about 10 or more carbon atoms such as, tetrapropenylsuccinic acid, tetradecenylsuccinic acid, and hexadecenylsuccinic acid. Another useful type of acidic corrosion inhibitors are the half esters of alkenyl succinic acids having about 8 to about 24 carbon atoms in the alkenyl group with alcohols such as the polyglycols. The corresponding half amides of such alkenyl succinic acids are also useful. A useful rust inhibitor is a high molecular weight organic acid. In some embodiments, an engine oil is devoid of a rust inhibitor.

The rust inhibitor, if present, can be used in optional amount sufficient to provide about 0 wt% to about 5 wt%, about 0.01 wt% to about 3 wt%, about 0.1 wt% to about 2 wt%, based upon the final weight of the lubricating oil composition.

The lubricant composition may also include corrosion inhibitors (it should be noted that some of the other mentioned components may also have copper corrosion inhibition properties). Suitable inhibitors of copper corrosion include ether amines, polyethoxylated compounds such as ethoxylated amines and ethoxylated alcohols, imidazolines, monoalkyl and dialkyl thiadiazole, and the like.

Thiazoles, triazoles and thiadiazoles may also be used in the lubricants. Examples include benzotriazole, tolyltriazole, octyltriazole, decyltriazole; dodecyltriazole, 2-mercaptobenzothiazole, 2,5-dimercapto-1,3,4-thiadiazole, 2-mercapto-5-hydrocarbylthio-1,3,4-thiadiazoles, and 2-mercapto-5-hydrocarbyldithio-1,3,4-thiadiazoles. In one embodiment, the lubricant composition includes a 1,3,4-thiadiazole, such as 2-hydrocarbyldithio-5-mercapto-1,3,4-dithiadiazole.

Anti-foam/Surfactant agents may also be included in a fluid according to the present invention. Various agents are known for such use. Copolymers of ethyl acrylate and hexyl ethyl acrylate, such as PC-1244, available from Solutia may be used. In other embodiments, silicone fluids, such as 4% DCF may be included. Mixtures of anti-foam agents may also be present in the lubricant composition.

EXAMPLES

The following examples are illustrative of exemplary embodiments of the disclosure. In these examples, as well as elsewhere in this application, all ratios, parts, and percentages are by weight unless otherwise indicated. It is intended that these examples are being presented for the purpose of illustration only and are not intended to limit the scope of the invention disclosed herein.

EXAMPLE 1

An exemplary organic polysulfide reaction product may be prepared as follows: a 300 mL stainless steel autoclave was charged with sulfur (67.2g, 1.92 gram atoms) and 0.1 mL n-butylamine (1.0 mmol). The autoclave was cooled in a dry ice isopropyl alcohol bath and sparged (4×100 psi) with $N_2$. Isobutylene (58.8g, 1.05 mole) was condensed into the autoclave. The autoclave was sealed and heated to 140° C. under an autogeneous pressure of 550 psi for 26.5 hours. After standing overnight the autoclave was vented to a caustic trap and a condenser cooled in dry ice and then heated to 10° C. and sparged with $N_2$ for 0.5 hours.

Next, a 100 mL round bottom flask equipped with an over-head stirrer and reflux condenser was charged with sodium hydrosulfide (10.8g, 46% aq) and sodium hydroxide (12.0g, 50% aq), and the sulfurized product prepared in Example 3A (20g). The solution was vigorously stirred and heated to 80° C. for 2 hours and 100° C. for 2 hours. After cooling, the solution was taken up in diethyl ether and poured into a separatory funnel.

Two organic sulfide reaction products were prepared consistent to the above with the amount of caustic (sodium hydroxide) varied as needed to form each of the reaction products:

Organic Sulfide Reaction Product A: the first organic sulfide reaction product had about 15 weight percent of compounds with an $S_2$ moiety, about 82 weight percent of compounds with a $S_3$ moiety, about 3 weight percent of compounds with a $S_4$ moiety, and no compounds with either a $S_5$ or $S_6$ moiety Reaction product A had a weight ratio of $S_3$ to $S_4$ of about 27.3:1. Sulfide profiles were determined by CNMR as described above.

Organic Sulfide Reaction Product B: the second organic sulfide reaction product had about 15 weight percent of compounds with an $S_2$ moiety, about 59 weight percent of compounds with a $S_3$ moiety, about 24 weight percent of compounds with a $S_4$ moiety, about 3 weight percent of compounds with a S5 moiety, and no compounds with a $S_6$ moiety Reaction product B had a weight ratio of $S_3$ to $S_4$ of about 2.5:1. Sulfide profiles were also determined by CNMR as described above.

EXAMPLE 2

The organic sulfide reaction products A and B of Example 1 were evaluated in lubricating compositions of Table 3 and tested for extreme pressure and copper corrosion. The lubricating compositions of Table 3, in addition to the noted organic sulfide component reaction products, included about 0.36 weight percent of methyl octadecyl phosphonate (MOP) and about 0.13 weight percent of a thiadiazole or derivative thereof. The lubricating compositions also included the same amounts an additive package including the same detergents, friction modifiers, a viscosity modifier, an antioxidant, rust inhibitor, corrosion inhibitor, seal swell agent, and antifoam agents. The compositions also included the balance of base oils and/or process oils as needed to achieve a target KV100 of about 13 to 14 cSt.

TABLE 3

| Component | Inventive 1 | Compare 1 | Compare 2 | Compare 3 |
|---|---|---|---|---|
| Organic Sulfide Reaction Product A | 2 wt % | — | 4 wt % | — |
| Organic Sulfide Reaction Product B | 2 wt % | 3 wt % | — | 4 wt % |
| Total sulfur form Reaction Products* | 1.8-1.9 wt % | 1.3-1.5 wt % | 1.7-1.9 wt % | 1.8-1.9 wt % |
| Total sulfur* | 1.9-2.1 wt % | 1.5-1.6 wt % | 1.8-2.0 wt % | 1.9-2.1 wt % |
| Percent of total sulfur from Reaction Products A and B | 92-99 wt % | 89-99 wt % | 92-99 wt % | 94-99 wt % |
| Sulfide profile of Mixture** | | | | |
| S2 | 15 wt % | 15 wt % | 15 wt % | 15 wt % |
| S3 | 70 wt % | 59 wt % | 82 wt % | 59 wt % |
| S4 | 14 wt % | 24 wt % | 3 wt % | 24 wt % |
| S5 | 1 wt % | 3 wt % | — | 3 wt % |
| S6 | — | — | — | — |
| Ratio of S3 to S4 | 5:1 | 2.5:1 | 27.3:1 | 2.5:1 |

*Sulfur amounts are calculated from each ingredient.

**Sulfur profiles determined by C NMR and reflect t-butyl isomers, but other isomers present would be in similar profiles and ratios.

Extreme pressure performance was measured using the FZG Sprung test as described in FVA information sheet #243 (designated as S-A-10/16.6R/90 or 120). The FZG Sprung test may be performed at any number of test houses, such as the FZG institute, Southwest Research Institute, or other suitable test house. Passing extreme pressure performance is a wear scar of about 100 $mm^2$ or less at a load stage of 9 or higher as compared to a reference lubricant. Copper corrosion was evaluated using ASTM D130 with passing performance being a 1A or 1B visual observation (3 hours at 121° C.) as set forth in the test method and/or less than about 200 mg of copper weight loss after 168 hours at 120° C. Test results are provided in Table 4 below.

TABLE 4

| Performance | Inventive 1 | Compare 1 | Compare 2 | Compare 3 |
|---|---|---|---|---|
| Extreme Pressure* | 72 $mm^2$ (LS9) | 76 $mm^2$ (LS10) | 424 $mm^2$ (LS9) | 122 $mm^2$ (LS9) |
| D130 new oil rating** | IB | 1A | — | — |
| D130 aged *** | IB | 3B | — | — |
| Copper weight Loss**** | 170 mg | 203 mg | 57 mg | 281 mg |

*passing performance is load stage (LS) 9 or higher with 100 $mm^2$ or less wear scar when compared to a reference fluid.
**passing performance is 1A or 1B rating.
***D130 aging is 2 week at 55 C.
****passing performance is less than 200 mg of weight loss.

Only the lubricating composition of Inventive Fluid 1 having a unique mixture of sulfur compounds provided by both organic sulfide reaction products A and B passed both the extreme pressure testing and the copper corrosion testing. While comparative fluid 1, which included a lower amount of total sulfur from only organic sulfide reaction product B, had good extreme pressure performance, it had too much copper weight loss and was unacceptable and failed the aged D130 testing. This result is surprising because Comparative Fluid 1 had less total sulfur and would have been expected to provide better copper corrosion results due to the lower levels of total sulfur. While Comparative Fluid 2 having the same treat rate of only organic sulfide reaction product A demonstrated low copper weight loss, it failed the extreme pressure testing and was unacceptable and not otherwise tested further. Lastly, Comparative Fluid 3 also had the same treat rate of only organic sulfide reaction product B, but this lubricant failed both the extreme pressure performance and copper corrosion weight loss and was not otherwise tested further.

EXAMPLE 3

The organic sulfide reaction products of Example 1 were further evaluated in driveline lubricating compositions of Table 5 below and tested for copper corrosion. The lubricating compositions of Table 5, in addition to the organic sulfide reaction products, included about 0.13 weight percent of a thiadiazole or derivative thereof. The lubricating compositions also included the same amounts of an additive package including the same detergents, friction modifiers, a viscosity modifier, an antioxidant, rust inhibitor, corrosion inhibitor, seal swell agent, antiwear additives, and antifoam agents. The fluids also included the balance of base oils and/or process oils to achieve a target KV100 of about 13 to about 14 cSt.

TABLE 5

| Component | Inventive 2 | Compare 4 | Compare 5 |
|---|---|---|---|
| Organic Sulfide Reaction Product A | 2 wt % | 2 wt % | 2 wt % |
| Organic Sulfide Reaction Product B | 2 wt % | 2 wt % | 2 wt % |
| Methyl octadecyl phosphonate (MOP) | 0.5 wt % | — | — |
| Dimethyl octadecyl phosphonate (DMOP) | — | — | 0.85 wt % |
| Sulfide profile of Mixture | | | |
| S2 | 15 | 15 | 15 |
| S3 | 70 | 70 | 70 |
| S4 | 14 | 14 | 14 |
| S5 | 1 | 1 | 1 |
| S6 | 0 | 0 | 0 |
| Ratio of S3 to S4 | 5:1 | 5:1 | 5:1 |

Copper corrosion was measured as set forth in Example 2. Test results are provided below in Table 6 below

TABLE 6

| Performance | Inventive 2 | Compare 4 | Compare 5 |
|---|---|---|---|
| D130 new oil rating | IB | Fail after Aging | 3A |

Only the Inventive 2 fluid having the mixture of organic sulfide compounds together was capable of achieving desired friction performance and passing copper corrosion. Comparative fluid 4 included the same mixture of organic sulfide compounds, but did not include any phosphorus friction modifier and was unable to achieve passing friction performance and was not tested further and expected to fail copper corrosion after aging. Comparative fluid 5 included dimethyl octadecyl phosphonate (DMOP) as a friction modifier, but this fluid failed copper corrosion testing likely because the dimethyl octadecyl phosphonate additive interacted negatively with the thiadiazole. Preferably, the lubricating compositions herein include about 0.5 weight percent or less of DMOP, more preferably about 0.25 weight percent or less, or about 0.1 weight percent or less, or most preferably no functional amounts of DMOP.

It is noted that, as used in this specification and the appended claims, the singular forms a," "an," and "the," include plural referents unless expressly and unequivocally limited to one referent. Thus, for example, reference to "an antioxidant" includes two or more different antioxidants. As used herein, the term "include" and its grammatical variants are intended to be non-limiting, such that recitation of items in a list is not to the exclusion of other like items that can be substituted or added to the listed items.

For the purposes of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that can vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques.

It is to be understood that each component, compound, substituent or parameter disclosed herein is to be interpreted as being disclosed for use alone or in combination with one or more of each and every other component, compound, substituent or parameter disclosed herein.

It is further understood that each range disclosed herein is to be interpreted as a disclosure of each specific value within the disclosed range that has the same number of significant digits. Thus, for example, a range from 1 to 4 is to be interpreted as an express disclosure of the values 1, 2, 3 and 4 as well as any range of such values.

It is further understood that each lower limit of each range disclosed herein is to be interpreted as disclosed in combination with each upper limit of each range and each specific value within each range disclosed herein for the same component, compounds, substituent or parameter. Thus, this disclosure to be interpreted as a disclosure of all ranges derived by combining each lower limit of each range with each upper limit of each range or with each specific value within each range, or by combining each upper limit of each range with each specific value within each range. That is, it is also further understood that any range between the endpoint values within the broad range is also discussed herein. Thus, a range from 1 to 4 also means a range from 1 to 3, 1 to 2, 2 to 4, 2 to 3, and so forth.

Furthermore, specific amounts/values of a component, compound, substituent or parameter disclosed in the description or an example is to be interpreted as a disclosure of either a lower or an upper limit of a range and thus can be combined with any other lower or upper limit of a range or specific amount/value for the same component, compound, substituent or parameter disclosed elsewhere in the application to form a range for that component, compound, substituent or parameter.

While particular embodiments have been described, alternatives, modifications, variations, improvements, and substantial equivalents that are or can be presently unforeseen can arise to applicants or others skilled in the art. Accordingly, the appended claims as filed and as they can be amended are intended to embrace all such alternatives, modifications variations, improvements, and substantial equivalents.

What is claimed is:

1. A lubricating composition comprising:

one or more base oil of lubricating viscosity;

at least about 1 weight percent of total sulfur provided by one or more additives and wherein a majority of the total sulfur is provided by organic sulfide compounds;

wherein each organic sulfide compound, independently, has a structure of the formula $R_1$-$S_x$-$R_2$ wherein $R_1$ and $R_2$, independently, are a C2 to C20 hydrocarbyl group and x is an integer of at least 2;

wherein the organic sulfide compounds have a weight ratio of organic sulfide compounds with $S_3$ moieties to $S_4$ moieties of 3:1 to 6:1, about 1 to about 5 weight percent of compounds with a $S_5$ moiety and no more than about 1 weight percent of compounds with a $S_6$ moiety;

a thiadiazole or a derivative thereof; and a phosphorous containing friction modifier providing a hydrocarbyl phosphonate monoester.

2. The lubricating composition of claim 1, wherein the lubricating composition includes about 1.3 to about 3 weight percent of total sulfur, at least about 90 weight percent of the total sulfur is provided by the organic sulfide compounds having about 10 to about 15 weight percent of organic sulfide compounds with a $S_2$ moiety, about 60 to about 70 weight percent of compounds with a $S_3$ moiety, and about 12 to about 20 weight percent of compounds with a $S_4$ moiety.

3. The lubricating composition of claim 1, wherein the organic sulfide compounds are provided by a first organic sulfide reaction product and a second organic sulfide reaction product.

4. The lubricating composition of claim 3, wherein the lubricating composition includes about 1.5 to about 2.8 weight percent of the first organic sulfide reaction product and about 1.5 to about 2.8 weight percent of the second organic sulfide reaction product.

5. The lubricating composition of claim 3, wherein the lubricating composition includes a weight ratio of the first organic sulfide reaction product to the second organic sulfide reaction product of about 0.8:1 to about 1:0.8.

6. The lubricating composition of claim 1, wherein $R_1$ and $R_2$, independently, are selected from propyl, isopropyl, butyl, isobutyl, tert-butyl, or combinations thereof.

7. The lubricating composition of claim 1, wherein the hydrocarbyl phosphonate monoester has a structure of Formula II (Formula II)

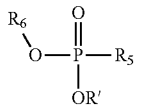

wherein $R_5$ is a $C_{12}$ to $C_3$o hydrocarbyl group, $R_6$ is a C1 to C4 alkyl group, and R' is hydrogen.

8. The lubricating composition of claim 1, wherein the lubricating composition includes about 0.1 weight percent to about 0.8 weight percent of the hydrocarbyl phosphonate monoester.

9. The lubricating composition of claim 1, wherein the thiadiazole or derivative thereof is selected from a mono hydrocarbyl thiol-substituted thiadiazole, a bishydrocarbyl thiol-substituted thiadiazole, or combinations thereof.

10. The lubricating composition of claim 9, wherein the thiadiazole is 1,3,4-thiadiazole or derivative thereof.

11. The lubricating composition of claim 1, wherein the lubricating composition includes about 1 weight percent or less of the thiadiazole or derivative thereof.

12. The lubricating composition of claim 1, wherein the thiadiazole or derivative thereof includes one or more compounds having a structure of Formula I:

(Formula I)

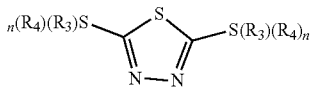

wherein each $R_3$ is independently hydrogen or sulfur;

each $R_4$ is independently an alkyl group;

n is an integer of 0 or 1 and if $R_3$ is hydrogen then the integer n of the adjacent $R_4$ moiety is 0 and if $R_3$ is sulfur then the n of the adjacent $R_4$ moiety is 1; and wherein at least one $R_3$ is sulfur.

13. The lubricating composition of claim 1, wherein the lubricating composition exhibits about 100 $mm^2$ or less damage in a FZG sprung test at 90° C. at load stage 9 or above when compared to a reference fluid and about 200 mg or less copper corrosion pursuant to ASTM D130.

14. A driveline lubricating composition comprising:

at least about 1 weight percent of total sulfur provided by a mixture of at least two dihydrocarbyl sulfide reaction products, each dihydrocarbyl sulfide reaction product is obtained from a source of sulfur reacted with one or more C2 to C20 hydrocarbyl or olefin compounds, and wherein the source of sulfur is substantially devoid of sulfur chlorides, hydrogen sulfides, and combinations thereof;

the first dihydrocarbyl sulfide reaction product includes a combination of organic sulfide compounds with a weight ratio of organic sulfide compounds with $S_3$ moieties to $S_4$ moieties of 20:1 to 30:1, no more than about 1 weight percent of compounds with a $S_5$ moiety, and no more than about 1 weight percent of compounds with a $S_6$ moiety;

the second dihydrocarbyl sulfide reaction product includes a combination of organic sulfide compounds with a weight ratio of organic sulfide compounds with $S_3$ moieties to $S_4$ moieties of 1.5:1 to 5:1, about 1 to about 5 weight percent of compounds with a $S_5$ moiety, and no more than about 1 weight percent of compounds with a $S_6$ moiety;

a thiadiazole or a derivative thereof; and a phosphorous containing friction modifier providing a hydrocarbyl phosphonate monoester.

15. The driveline lubricating composition of claim 14, wherein the source of sulfur is elemental sulfur.

16. The driveline lubricating composition of claim 14, wherein the lubricating composition includes a weight ratio of the first dihydrocarbyl sulfide reaction product to the second dihydrocarbyl sulfide reaction product of about 0.8:1 to about 1:0.8.

17. The driveline lubricating composition of claim 14, wherein the hydrocarbyl phosphonate monoester has a structure of Formula II (Formula II)

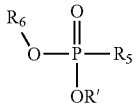

wherein $R_5$ is a $C_{12}$ to $C_3$o hydrocarbyl group and $R_6$ is a C1 to C4 alkyl group, and R' is hydrogen.

18. The driveline lubricating composition of claim 14, wherein the lubricating composition includes about 0.1 weight percent to about 0.8 weight percent of the hydrocarbyl phosphonate monoester.

19. The driveline lubricating composition of claim 14, wherein the thiadiazole or derivative thereof is selected from a mono hydrocarbyl thiol-substituted thiadiazole, a bishydrocarbyl thiol-substituted thiadiazole, or combinations thereof.

20. The driveline lubricating composition of claim 14, wherein the lubricating composition includes about 1 weight percent or less of the thiadiazole or derivative thereof.

21. The driveline lubricating composition of claim 20, wherein the thiadiazole or derivative thereof includes one or more compounds having a structure of Formula I:

(Formula I)

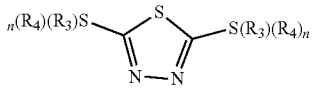

wherein each $R_3$ is independently hydrogen or sulfur;

each $R_4$ is independently an alkyl group;

n is an integer of 0 or 1 and if $R_3$ is hydrogen then the integer n of the adjacent $R_4$ moiety is 0 and if R3 is sulfur then the n of the adjacent $R_4$ moiety is 1; and wherein at least one $R_3$ is sulfur.

22. The driveline lubricating composition of claim 14, wherein the lubricating composition exhibits about 100 $mm^2$ or less damage in a FZG sprung test at 90° C. at load stage 9 or above and about 200 mg or less copper corrosion pursuant to ASTM D130.

23. A method of lubricating a driveline, the method comprising lubricating a driveline component with a lubricating composition of claim 1.

* * * * *